US009598163B1

(12) United States Patent
Gable et al.

(10) Patent No.: US 9,598,163 B1
(45) Date of Patent: Mar. 21, 2017

(54) SYSTEM AND METHOD OF STEERING A MARINE VESSEL HAVING AT LEAST TWO MARINE DRIVES

(71) Applicant: Brunswick Corporation, Lake Forest, IL (US)

(72) Inventors: Kenneth G. Gable, Oshkosh, WI (US); Brad E. Taylor, Guthrie, OK (US); Steven J. Andrasko, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/004,038

(22) Filed: Jan. 22, 2016

(51) Int. Cl.

| | |
|---|---|
| ***B63H 25/24*** | (2006.01) |
| ***B63H 20/12*** | (2006.01) |
| ***B63H 25/42*** | (2006.01) |
| ***B63H 25/26*** | (2006.01) |

(52) U.S. Cl.
CPC ..... *B63H 25/24* (2013.01); *B63H 20/12* (2013.01); *B63H 25/26* (2013.01); *B63H 25/42* (2013.01)

(58) Field of Classification Search
CPC ..... B63H 20/12; B63H 5/125; B63H 21/21; B63H 21/22; B63H 25/42; B63H 5/08; B63H 25/02
USPC ..... 114/144 E, 144 R; 440/1, 61 S, 63; 701/21, 42
See application file for complete search history.

(56) References Cited

U.S. PATENT DOCUMENTS

| | | | |
|---|---|---|---|
| 6,402,577 | B1 | 6/2002 | Treinen et al. |
| 6,821,168 | B1 | 11/2004 | Fisher et al. |
| 7,150,664 | B1 | 12/2006 | Uppgard et al. |
| 7,255,616 | B1 | 8/2007 | Caldwell |
| 7,467,595 | B1 | 12/2008 | Lanyi et al. |
| 7,527,538 | B2 | 5/2009 | Mizutani |
| 8,046,122 | B1 | 10/2011 | Barta et al. |
| 8,512,085 | B1 | 8/2013 | Kobilic |
| 2015/0246714 | A1 * | 9/2015 | Morikami ..... B63H 20/12 701/21 |

OTHER PUBLICATIONS

Pending U.S. Appl. No. 14/177,762, filed Feb. 11, 2014, Andrasko, entitled "Systems and Methods for Controlling Movement of Drive Units on a Marine Vessel".
Pending U.S. Appl. No. 14/843,439, filed Sep. 2, 2015, Andrasko, entitled Systems and Methods for Continuously Adapting a Toe Angle Between Marine Propulsion Devices.
Pending U.S. Appl. No. 14/960,551, filed Dec. 7, 2015, Gable, entitled Methods and Systems for Controlling Steering Loads on a Marine Propulsion System.

* cited by examiner

*Primary Examiner* — Lars A Olson
(74) *Attorney, Agent, or Firm* — Andrus Intellectual Property Law LLP

(57) ABSTRACT

In one embodiment, a system for steering a marine vessel includes a first marine drive having a first engine control module and a second marine drive having a second engine control module, where the first and second marine drives are connected by a mechanical link. A first steer-by-wire steering actuator is configured to rotate the first and second marine drives to steer the marine vessel, and a first actuator control module controls the first steer-by-wire steering actuator. The system operates such that the first actuator control module activates the first steer-by-wire steering actuator if either the first marine drive or the second marine drive is running.

20 Claims, 6 Drawing Sheets

SYSTEM AND METHOD OF STEERING A MARINE VESSEL HAVING AT LEAST TWO MARINE DRIVES

FIELD

The present disclosure relates to methods and systems for controlling steering actuators in a marine propulsion system. More specifically, the present disclosure relates to methods and systems for steering a marine vessel having one or more sets of at least two marine propulsion devices rotated by a single steering actuator.

BACKGROUND

The following U.S. patents and patent applications are hereby incorporated herein by reference.

U.S. Pat. No. 6,821,168 discloses an outboard motor provided with an internally contained cylinder and moveable piston. The piston is caused to move by changes in differential pressure between first and second cavities within the cylinder. The hydraulic steering system described in U.S. Pat. No. 6,402,577 is converted to a power hydraulic steering system by adding a hydraulic pump and a steering valve to a manual hydraulic steering system.

U.S. Pat. No. 7,150,664 discloses a steering actuator system for an outboard motor that connects an actuator member to guide rails, which are, in turn, attached to a motive member such as a hydraulic cylinder. The hydraulic cylinder moves along a first axis with the guide rail extending in a direction perpendicular to the first axis. An actuator member is movable along the guide rail in a direction parallel to a second axis and perpendicular to the first axis. The actuator member is attached to a steering arm of the outboard motor.

U.S. Pat. No. 7,255,616 discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that it allows it to rotate in conformance with movement of a steering arm of a marine propulsion device.

U.S. Pat. No. 7,467,595 discloses a method for controlling the movement of a marine vessel including rotating one of a pair of marine propulsion devices and controlling the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 8,046,122 discloses a control system for a hydraulic steering cylinder utilizing a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the disclosed invention in order to allow accurate and controlled movement of a steering device in response to movement of a steering wheel of a marine vessel.

U.S. Pat. No. 8,512,085 discloses a tie bar apparatus for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

U.S. patent application Ser. No. 14/177,762, filed Feb. 11, 2014, discloses a system for controlling movement of a plurality of drive units on a marine vessel having a control circuit communicatively connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit steering angle.

U.S. Pat. No. 7,527,538 discloses a small boat has multiple propulsion units. A toe angle of the multiple propulsion units can be altered while the boat is under way. The toe angle can be adjusted to improve performance in any of a number of areas, including top speed, acceleration, fuel economy, and maneuverability, at the demand of the operator.

U.S. patent application Ser. No. 14/843,439, filed Sep. 2, 2015 discloses systems and methods for reducing steering pressures of marine propulsion device steering actuators are disclosed. First and second sensors sense first and second conditions of first and second steering actuators. A third sensor senses an operating characteristic of the marine vessel. A controller is in signal communication with the first, second, and third sensors. In response to the marine vessel travelling generally straight ahead, the controller determines a target toe angle between the first and second marine propulsion devices based on the operating characteristic. The controller commands the first and second steering actuators to position the first and second marine propulsion devices at the target toe angle. The controller thereafter gradually adapts the target toe angle between the first and second marine propulsion devices until the controller determines that an absolute difference between the first condition and the second condition reaches a calibrated value.

U.S. patent application Ser. No. 14/960,551, filed Dec. 7, 2015 discloses a method of controlling steering loads on a marine propulsion system of a marine vessel. The marine vessel has at least two sets of marine drives, each set having at least an inner marine drive and an outer marine drive, and a steer-by-wire steering actuator is associated with each set of marine drives. The method includes determining a maximum required actuator pressure on each steer-by-wire steering actuator, and determining a pressure reduction amount based on the maximum required actuator pressure. A link toe angle has been determined based on the pressure reduction amount. A mechanical link connecting each inner marine drive to the respective outer marine drive is adjusted to achieve the link toe angle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a system for steering a marine vessel includes a first marine drive having a first engine control module and a second marine drive having a second engine control module, where the first and second marine drives are connected by a mechanical link. A first steer-by-wire steering actuator is configured to rotate the first and second marine drives to steer the marine vessel, and a first actuator control module controls the first steer-by-wire steering actuator. The system operates such that the first actuator control module activates the first steer-by-wire steering actuator if either the first marine drive or the second marine drive is running.

One embodiment of a method for controlling steering of a set of marine drives connected by a mechanical link includes receiving an engine speed of a first marine drive at an actuator control module that controls a steer-by-wire steering actuator, and receiving an engine speed of a second marine drive at the actuator control module. The method further includes determining that at least one of the first engine speed or the second engine speed is at least a threshold value, and activating the steer-by-wire steering actuator to rotate the first and second marine drives to steer the marine vessel.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
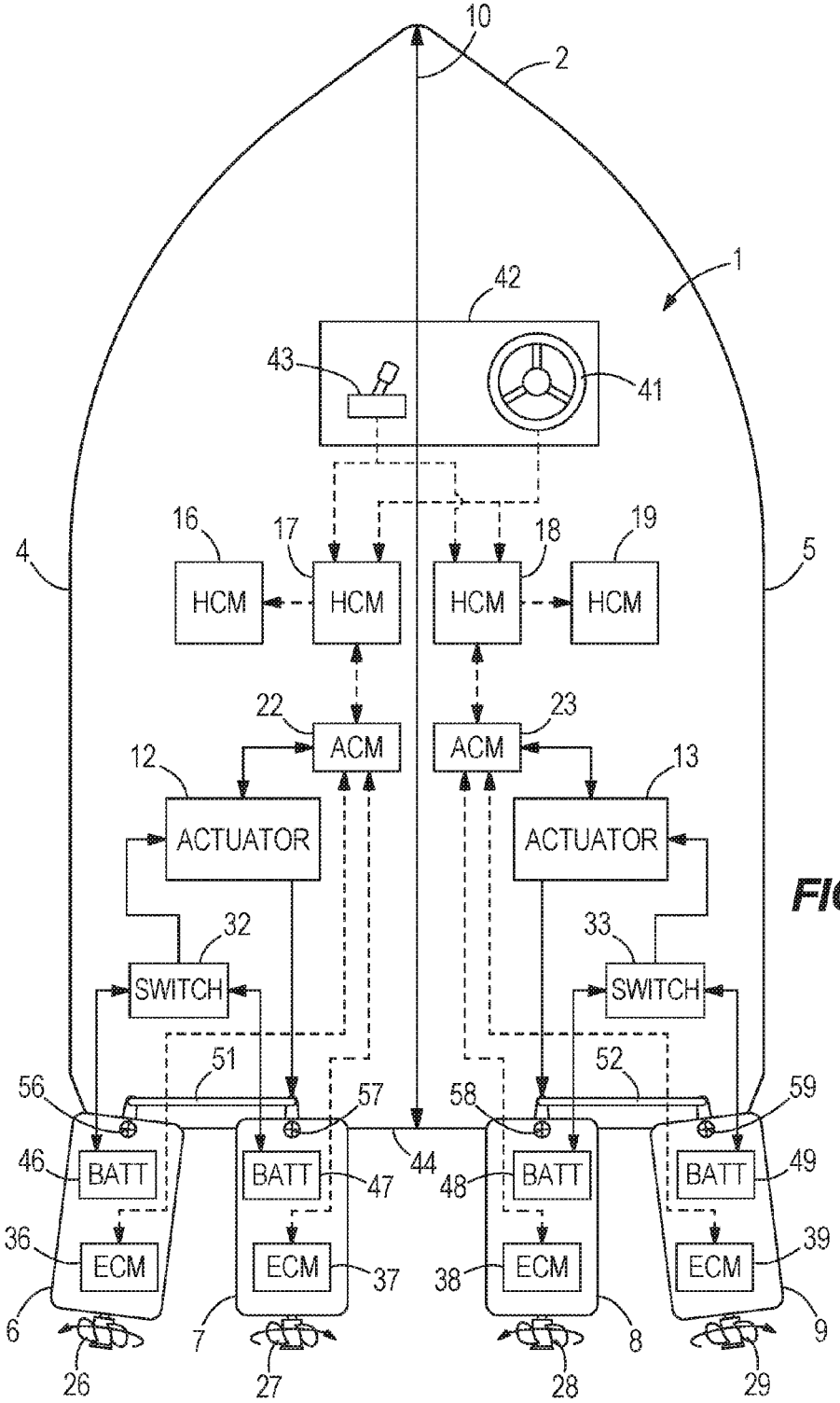
FIG. 1 illustrates one embodiment of a marine vessel having a marine propulsion system including two sets of marine drives, each set of marine drives having at least an inner marine drive and an outer marine drive.
Figure 2:
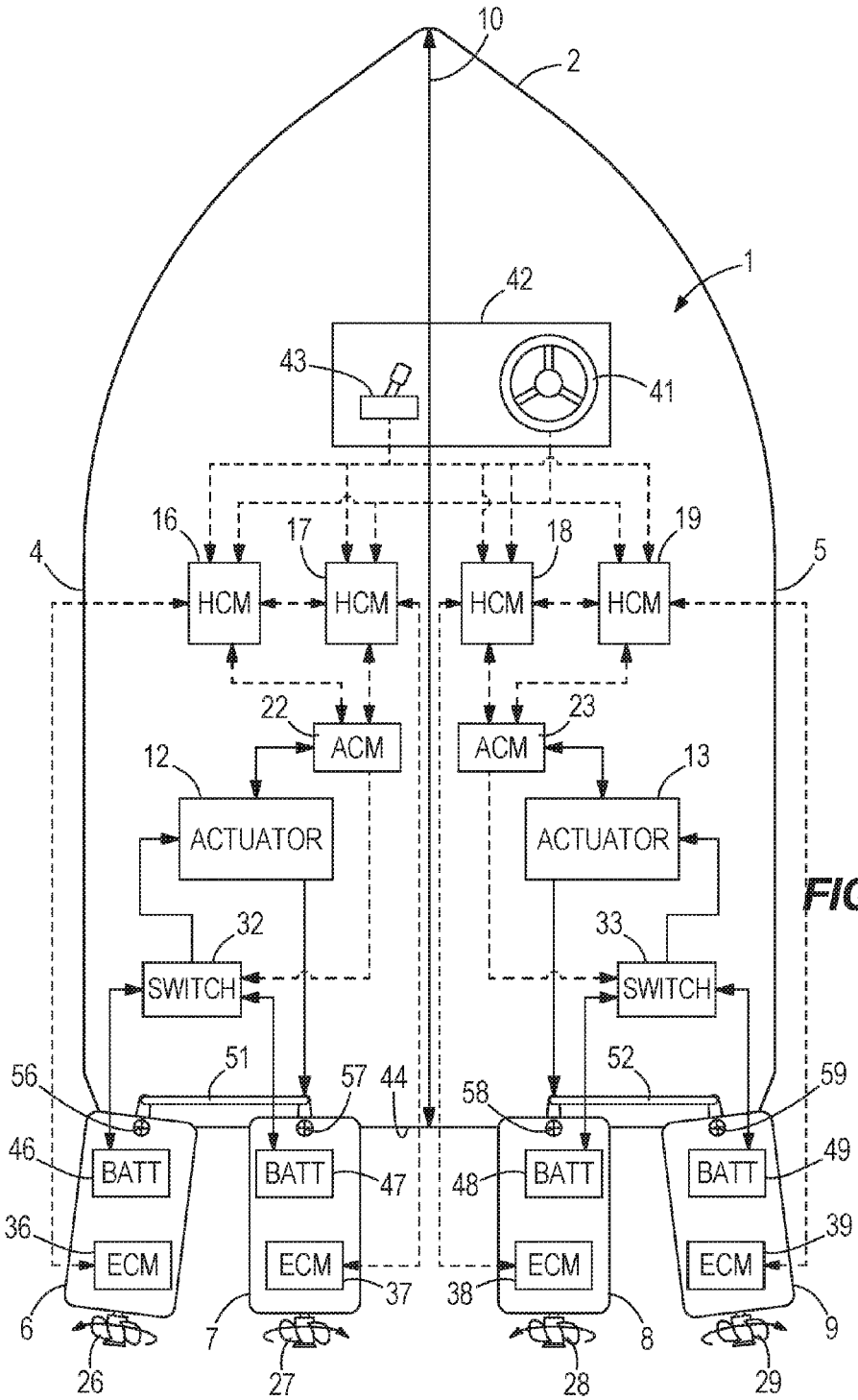
FIG. 2 illustrates another embodiment of a marine vessel having a marine propulsion system including two sets of marine drives, each set of marine drives having at least an inner marine drive and an outer marine drive.

FIGS. 1 and 2 illustrate a marine vessel 2 having a marine propulsion system 1 in accordance with the present disclosure. The marine propulsion system 1 includes four marine drives 6-9, which are outboard motors coupled to the transom 44 of the marine vessel 2. The marine drives 6-9 are attached to the vessel 2 in a conventional manner such that each drive 6-9 is rotatable about a respective vertical steering axis 56-59. In the depicted examples, the marine drives 6-9 are configured in two sets of two marine drives, one set on each side of the centerline 10 along the keel. Marine drives 6 and 7 comprise one set fixed to the port side 4 of the stern 3 (port of the centerline 10), and marine drives 8 and 9 comprise the second set fixed to the starboard side 5 of the stern 3. The first set of marine drives 6 and 7 include outer port drive 6 and inner port drive 7. The second set of marine drives 8 and 9 include inner starboard drive 8 and outer starboard drive 9. Other embodiments may include more than four drives, such as six or eight drives. The drives may be configured in two or more sets evenly distributed around the center line 10. For example, a marine propulsion system 1 having eight drives may be configured in two sets of four drives or four sets of two drives. Likewise, the marine propulsion system 1 may have two sets of three drives, for a total of six. In the embodiments depicted in the FIGURES, the marine drives are outboard motors; however, a person having ordinary skill in the art will understand in light of this disclosure that in other embodiments the marine drives 6-9 may be inboard/outboard motors or stern drives mechanically connected together and controlled in the same arrangements as is depicted and described with respect to the FIGURES.

Each set of marine drives is connected together with a mechanical link 51, 52. In one example, the mechanical link is an adjustable tie bar, such as that described in U.S. Pat. No. 8,512,085; however, a person having ordinary skill in the art will understand in view of this disclosure that other mechanical link arrangements are appropriate. Mechanical link 51 connects the port inner marine drive 7 to the port outer marine drive 6. Likewise, the mechanical link 52 connects the inner starboard marine drive 8 to the outer starboard marine drive 9. The mechanical links 51, 52 maintain a set distance between the inner and outer marine drives in each set such that as one drive turns, the other drive in the set also turns in the same direction and by an equal amount. In other words, the inner marine drive and the outer marine drive of each set are steered together.

The sets of marine drives 6 and 7, 8 and 9 are capable of being steered separately to different angles. This allows the marine drives 6-9 to operate in many different modes, including in a joystick mode such as that described in U.S. Pat. No. 7,467,595 incorporated by reference herein above. While in joystick mode, each steer-by-wire steering actuator 12, 13 may rotate the associated set of marine drives 6 and 7, 8 and 9 independently of one another to different steering angles about their steering axes. In other modes, the two sets of drives 6 and 7, 8 and 9 may be operated simultaneously and symmetrically, with the steer-by-wire steering actuators 12 and 13 operating the respective sets of drives 6 and 7, 8 and 9 by rotating them in equal and opposite directions.

Equipping a marine vessel 2 with four drives provides increased propulsion power allowing for high speeds of travel, including upwards of 65 MPH or 90 MPH or higher, and/or for propelling heavy vessels 2. Traditionally, vessels provided with four or more drives have all four drives tied together, such as with a combination of tie bars and hydraulic hoses and actuators, so that all engines work and steer in unison. The tying of all four drives was required in prior art systems because the tie bars were needed to bear much of the pressure created by hydrodynamic forces on the drives when operating at high speeds and/or under heavy steering loads. Thus, prior art vessels with high speed capabilities could not be outfitted with joysticking capabilities because they could not offer the independent steering capabilities required.

Through their experimentation and research in the relevant field, the present inventors have recognized that it is desirable to provide a marine vessel 2 with four marine drives that can be operated in a joysticking mode. Operation in joysticking mode requires at least two drives that are steered independently of one another in order to provide sufficient flexibility and precision of propulsion forces, as described in U.S. Pat. No. 7,467,595 which is incorporated by reference above. Accordingly, operation in a joysticking mode requires a steer-by-wire system, where individual steering actuators separately control rotation of each set of marine drives, such as through hydraulic steering systems or combination electric/hydraulic steering systems. Since each set of marine drives is mechanically linked, only one steering actuator is used to drive each pair. One example of a steer-by-wire control system is provided at U.S. Pat. No. 7,941,253, which is hereby incorporated herein by reference. While in joysticking mode, each steer-by-wire steering actuator orients the associated marine drives independently of one another and to different steering angles in response to manipulation of an input device at the helm 42, such as steering wheel 41 or joystick 43.

The present inventors have also recognized that providing a high speed marine vessel with joysticking capabilities poses problems and challenges, specifically with respect to the steering system and to providing sufficient steering pressure with steer-by-wire steering actuators to steer the marine vessel 2 at high speeds. The inventors recognized that hydrodynamic forces on the marine drives 6-9 can overwhelm steering actuators associated therewith such that the steering actuator for the set of drives is incapable of providing sufficient hydraulic pressure to overcome the hydrodynamic forces and rotate the marine drives in order to effectively steer at high speeds. The inventors have recognized that this problem is especially acute in the presently disclosed system, where one steering actuator 12, 13 must produce sufficient force to steer two drives.

Additionally, a person having ordinary skill in the art will recognize in light of the present disclosure that the steering control methods and systems describe herein may apply equally to a propulsion system 1 having only one set of marine drives, and the set may include any number of two or more drives connected together by a mechanical link such that steering can be enacted by a single steering actuator. The depicted control arrangement may also apply to a marine vessel having three marine drives tied together and connected to a single steering actuator.

Hydrodynamic forces on the marine drives are caused both by the propellers of the propulsion devices themselves as they push against the water (herein after propeller pressure) and by water moving off the hull of the vessel 2 and subsequently hitting each marine drive (herein after hull displacement pressure). During operation, unbalanced propeller pressure and hull displacement pressure require very high contrasting forces to be exerted by the steering systems, and specifically the steering actuators 51, 52, in order to maintain the marine drives 6-9 at the desired steering angles. The high pressures can overwhelm the steering actuators, which may cause the marine vessel 2 to become unresponsive to steering inputs by an operator and may further cause steering diagnostic errors.

Certain hydrodynamic forces can be decreased by positioning the marine drives 6-9 at a particular toe angle. Applicant's co-pending application Ser. No. 14/177,762, filed Feb. 11, 2014, entitled "Systems and Methods for Controlling Movement of Drive Units on a Marine Vessel," which was incorporated by reference herein above, discusses how marine propulsion devices, especially one provided in a pair, triple, or quad configuration, can be steered to different steering angles from one another so as to cause each of the propulsion devices to incur substantially the same hydrodynamic load while the marine vessel is turning. The '762 application does not, however, address the situation in which the marine vessel is traveling generally straight ahead. Applicant's co-pending application Ser. No. 14/843,439, filed Sep. 2, 2015, entitled "Systems and Methods for Continuously Adapting a Toe Angle Between Marine Propulsion Devices," which was also incorporated by reference herein above, discusses a system having a pressure sensor in each steer-by-wire steering actuator that constantly monitors the pressure on the steering system and adjusts the toe angle of the drives in a closed-loop feedback control algorithm in order to minimize hydrodynamic forces on each marine drive.

However, the present inventors have recognized that simply controlling the toe angle of each drive 6-9 with a single steering actuator does not provide sufficient pressure relief to counteract the hydrodynamic forces on marine vessels at very high speeds. Further, the inventors have recognized that such forces can be transferred to, and at least partially counteracted by, a mechanical link 51, 52 between the inner and outer drives in a set. Moreover, the inventors have recognized that the forces can be further counteracted by connecting the drives with the mechanical link at a particular toe angle, thereby reducing inefficiencies in the steering system and illuminating possible diagnostic faults due to failure of the steering actuators to achieve the required counteracting steering forces. Accordingly, the inventors developed the present system that reduces the pressure on the steer-by-wire steering actuators 12, 13 wherein the four marine drives 6-9 are divided into two sets 6 and 7, 8 and 9, and each set is connected by a mechanical link 51, 52 that connects the inner and outer marine drives at a defined toe angle. Each set of marine drives 6 and 7, 8 and 9 can then be rotated by a single steering actuator to further adjust the toe position of the marine drives, such as to a greater positive toe angle, and to steer the marine vessel. The presently disclosed system with pairs of drives tied together has the added benefit that only one steering actuator 12, 13 is needed per set of drives, which provides for a simpler system and reduces costs.

Figures 3A, 3B, 3C:
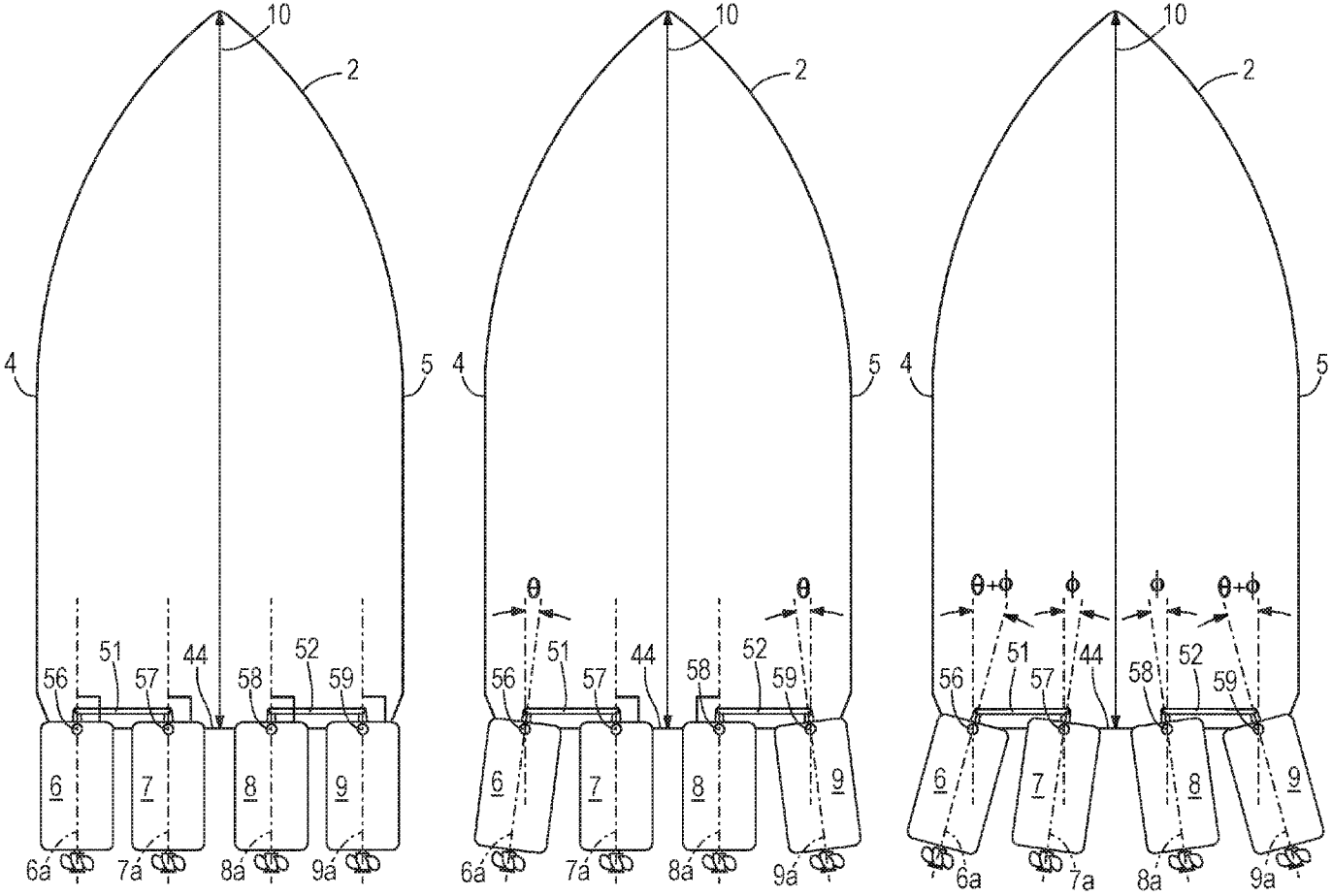
FIGS. 3A-3E illustrate examples of marine vessels containing four marine drives positioned at various toe angles.
Figure 3E:
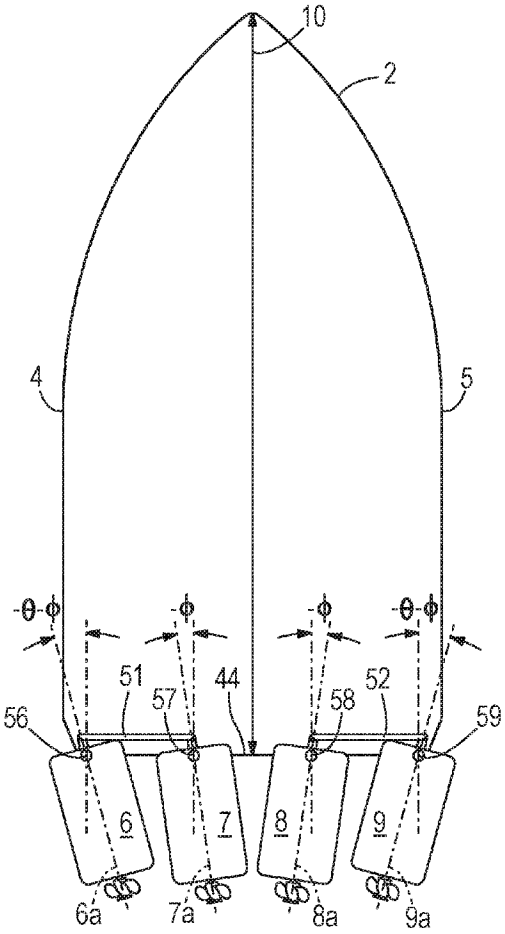
Figure 3D:
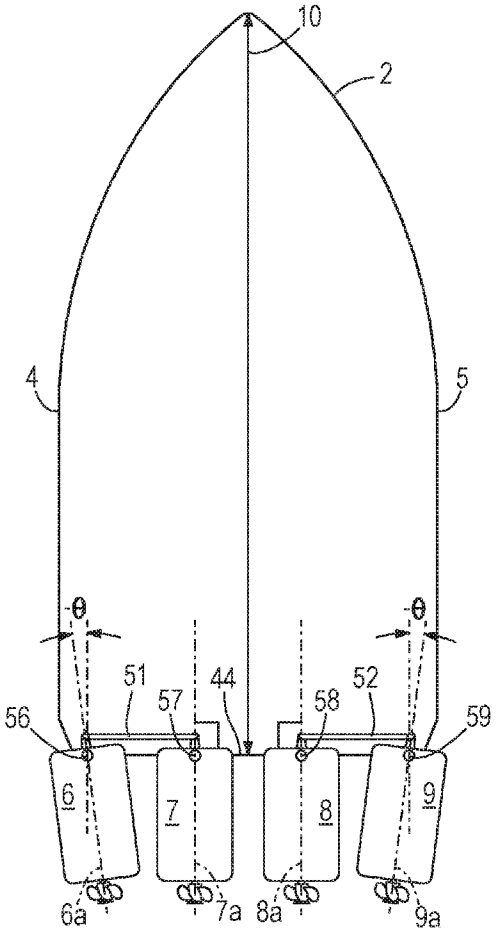

For example, referring to FIGS. 3A-3E, four marine drives 6-9 may be connected to the transom 44 of marine vessel 2, with two marine drives on either side of the center line 10 along the vessel's keel. As described above, each marine drive 6-9 is mounted to the transom 44 such that it can be rotated about a generally vertical steering axis 56-59 for each drive. FIG. 3A depicts the marine drives 6-9 oriented in a straight ahead, or neutral, position where a center line 6*a*-9*a* of each marine drive runs generally parallel to the center line 10 of the marine vessel 2. As is known to those having ordinary skill in the art, the marine drives 6-9 may be oriented in a "toe-in" orientation, wherein the marine drives 6-9 are each rotated such that their fore-most ends are turned towards the center line 10. For purposes of this disclosure, such a "toe-in" orientation will be referred to as positive toe, where the toe angle is considered to be a positive number. FIGS. 3B and 3C each depict an exemplary "toe-in" configuration of marine drives 6-9. Those having ordinary skill in the art will also know that the marine drives 6-9 can be oriented in a "toe-out" orientation in which each of their aft-most ends are rotated toward the center line 10 of the marine vessel 2. FIGS. 3D and 3E each depict an exemplary "toe-out" configuration of marine drives 6-9. For purposes of this disclosure, such a "toe-out" orientation will be referred to as negative toe, where the toe angle is expressed as a negative number. For purposes of this disclosure, toe angles are expressed as an angle degree away from the parallel position, depicted in FIGS. 3A-3C. The parallel position of the marine drive 6-9 is where the center line 6*a*-9*a* of each marine drive runs generally parallel to the center line 10 and generally perpendicular to the transom 44 of the marine vessel 2. The toe angles of the marine propulsion devices 6-8 depicted in FIGS. 3B-3E are exaggerated for purposes of illustration, and in reality the toe angles generally required by the systems and methods disclosed herein will range from about −3° to about 3° from the parallel position. Additionally, it should be understood that the marine vessel 2 is propelled in a generally straight ahead direction despite angling of the marine propulsion devices 6-9 to achieve a given toe angle. Any sideways thrust from one marine drive is cancelled by an opposing sideways thrust from a marine drive on the opposite side of the center line 10 of the marine vessel 2, resulting in additive forward thrust.

Referring again to FIG. 1, each set of marine drives 6 and 7, 8 and 9 is associated with a steer-by-wire steering actuator 12, 13. Each steer-by-wire steering actuator (hereinafter "steering actuator") 12, 13, may be any of various types of actuators, including hydraulic over electric actuators, pure electric actuators, direct driven hydraulic actuators, or any other steer-by-wire technology. Steering actuator 12 is associated with the port set of marine drives 6 and 7. Steering actuator 13 is associated with the starboard set of marine drives 8 and 9. Each actuator 12 and 13 is associated with actuator control module (ACM) 22 and 23, respectively. In one embodiment, the switches 32 and 33 operate to select the battery with the greatest charge. In the depicted embodiment, the steering actuators 12, 13 are connected to the inner drives 7, 8, and steering motion is transferred from the inner drives 7, 8 to the outer drives 6, 9 via the mechanical links 51, 52. However, the opposite configuration is also possible, where the steering actuators 12, 13 are connected to the outer drives 6, 9 and the mechanical links 51, 52 transfer steering motion to the inner drives 7, 8.

Each actuator 12, 13 is also associated with a switch 32 and 33, respectively, that selects which drive 6-9 powers the actuator 12, 13. Switch 32 alternately connects the actuator 12 to be powered by the battery 46 of inner port drive 6 or the battery 47 of outer port drive 7. Likewise, switch 33 alternately connects actuator 13 to battery 48 of inner starboard drive 8 or battery 49 of outer starboard drive 9. The switch may be any type of device capable of alternately making the electrical connection between the actuator 12, 13 and the respective one of the associated drives 6, 7 or 8, 9. In one exemplary embodiment, the switch 32 is an automatic transfer switch, such as the 895091K03 power switch assembly provided by Mercury Marine of Fond du Lac, Wis. In another embodiment, the switch 32, 33 could be a relay controlled by the respective actuator control module 22, 23, as is provided in the system diagram at FIG. 2. For example, the ACM 22, 23 may determine the state of charge, or battery capacity, of each associated battery 46 and 47, 48 and 49, and control the respective switch 32, 33 to connect the actuator 12, 13 to the battery 46 or 47, 48 or 49 having the greater capacity. In one embodiment, the actuator control module 22, 23 may receive the state of charge of each battery 46-49 from the ECM 36-39 associated with that drive 6-9. In another embodiment, the ACM 22, 23 may receive the state of charge information from the respective HCM 16-19. In still another embodiment, the ACM 22, 23 may receive the state of charge information from one or more gauges in electrical connection with each battery 46-49 that measure and communicate the charge level to the respective ACM 22, 23.

Each ACM 22, 23 functions to control the associated actuator 12, 13, and is provided with programming that executes the steering control methods. Upon startup, each ACM 22, 23 determines whether either one of its associated drives 6 or 7, 8 or 9 are functioning. If either drive is functioning, the ACM 22, 23 activates the steering actuator 12, 13, such as by powering on the actuator 12, 13 and preparing it to execute a steering command. Additionally, in an embodiment having electric over hydraulic steering actuation, the hydraulic pump may also be powered. Thus, if either marine drive in each set of marine drives 6 and 7, 8 and 9 is operating, then the set will be steered so that the functioning marine drive can be utilized for propelling and steering the marine drive 2, rather than shutting down both marine drives in the pair when only one is not operational. In the situation where one of the marine drives in a pair 6 and 7, 8 and 9 is not functioning, the switch 32, 33 would connect the actuator 12, 13 with the battery 46 or 47, 48 or 49, of the functioning marine drive. The ACM 22, 23 may determine the functioning state of its associated marine drives 6 and 7, 8 and 9 by communication with the respective ECM 36-39. For example, the ACM 22, 23 may receive the engine rpm of each of its respective drives from the ECMs 36 and 37, 38 and 39. In one embodiment, each set of marine drives may be connected to a single controller area network (CAN bus). Accordingly, ECM 36 and ECM 37 may transmit engine rpm values to ACM 22 via a first CAN bus, and ECM 38 and ECM 39 may transmit engine rpm value to ACM 23 via a second CAN bus. In an alternative embodiment, all ECMs and ACMs may be connected on a single CAN bus. For another embodiment, all modules on the vessel may be connected on a single CAN bus, and a redundant CAN bus may be provided for each branch (port and starboard) of the system. Thus, each module may be on two command-capable CAN busses. In another embodiment shown in FIG. 2 and described below, the ACMs 23, 23 may receive the engine speed values, or another value indicating that the associated drives are operating, from the respective HCMs.

The ACM 22, 23 activates the respective steering actuator 12, 13 if the engine rpms are at least a threshold value. For example, the ACM 22, 23 may activate the steering actuator 12, 13 if either of its associated marine drives 6 or 7, 8 or 9 have at least a threshold engine speed of 400 rpm. In other embodiments, the threshold engine speed may be higher or lower. Depending on the drive type and construction, the engine may idle around 650 rpm. Certain events, such as shifting into a forward gear or a reverse gear, may cause the engine speed to dip below its idle speed. Thus, it may be preferable to set the threshold value below the engine idle speed so that false negatives are avoided. If the threshold rpm value is set too high, then the ACM 22, 23 may not activate the actuator 12, 13 when its associated marine drives 6 and 7, 8 and 9 are running, which would mean that the set of marine drives would not be steerable. Further, it is known that the starter may cause an engine to turn at a relatively low rpm, even if the engine does not actually fire up. For example, a starter may cause an engine to turn at up to 200 rpm. Thus, it may be desirable to set the threshold value above the maximum engine speed that may be induced by the starter alone so that false positives are avoided—i.e., the ACM 22, 23 can avoid activating the steering actuator 12, 13 falsely and draining the batteries 46 and 47, 48 and 49.

The embodiments of FIGS. 1 and 2 depict marine vessels 2 having four outboard marine drives 6-9. However, the methods and systems described herein apply equally to marine vessels having only one pair of marine drives tied together, which may be outboard motors, inboard/outboard motors, or stern drives, as explained above.

Each marine drive 6-9 is controlled by a respective helm control module (HCM) 16-19. Each HCM 16-19 is communicatively connected to the engine control module (ECM) 36-39 to control the function of the respective marine drive 6-9. The dashed lines depicted in FIGS. 1 and 2 demonstrate the steering control hierarchy of the depicted embodiment. Steering control inputs are provided by an operator through steering input devices, such as steering wheel 41 and/or joystick 43. Alternatively or additionally, steering outputs may be automatically provided by an autopilot system.

In the embodiment of FIG. 1, steering commands from the input devices go to the HCMs 17, 18 for the inner marine drives 7, 8. As the outer drives 6, 9 are connected to the inner drives 7, 8, via adjustable mechanical links 51, 52, they are not separately steerable from the inner drives. For purposes of the depicted steering configuration, the outer drives 6,9 are "slaves" to the dominant inner drives 7,8, and thus the HCMs 16, 19 of the outer drives 6,9 do not output steering control commands to the ACMs 22,23. Helm control module 17 processes and transmits steering commands for the port set of marine drives 6 and 7, while the HCM 18 processes and transmits steering commands for the starboard set of marine drives 8 and 9. The port HCM 17 communicates steering commands to ACM 22 for the port side actuator 12. The port HCM 17 also communicates the steering commands and/or information relevant to steering conditions to HCM 16 for the outer port drive 6. The starboard HCM 18 communicates steering commands to ACM 23 for the starboard side actuator 13. The starboard HCM 18 also communicates the steering commands and/or information relevant to steering conditions to HCM 19 for the outer starboard drive 9. The ACMs 22, 23 and the steering actuators 12, 13 then control the steering position of the respective set of marine drives 6 and 7, 8 and 9.

In the instance of a malfunction or fault status of one of the steering actuators 12, 13, the respective ACM 22,23 will detect and communicate the steering fault status to the dominant HCM 17, 18 associated with the faulting actuator 12,13. For example, a steering fault status may arise if the steering actuator 12, 13 is unable to effectuate the steering command, such as not having the ability to provide the force necessary to execute the command, or if the steering actuator 12, 13 fails all together and can no longer operate. This steering fault status may then be communicated from the dominant HCM 17, 18 to the respective "slave" HCM 16, 19. Furthermore, the dominant HCM 17, 18 receiving the steering fault status may also communicate it to the other dominant HCM so that all of the HCMs are then aware of the steering fault status and can command accordingly. Depending on the cause or content of the communicated steering fault status, the HCMs may command accordingly. For example, if the steering fault status relates to insufficient power, then the dominant HCMs 17 and 18 may command that the drives 6-9 be toed to a greater toe angle. If the steering fault status relates to a failure of one of the steering actuators 12, 13, then the HCMs may adjust their steering algorithm to account for the inability to steer one set of marine drives.

In another embodiment similar to that depicted in FIG. 1, the ACMs 22 and 23 may be associated with the HCMs 16 and 19 for the outer drives 6 and 9. In such an embodiment, the inner drives 7 and 8 would be the "slaves" to the dominant outer drives 6 and 9. In such an embodiment, the steering device 41 and 43 may communicate with the HCMs 16 and 19 for the outer drives 6 and 9. However, in other embodiments, the steering devices 41 and 43 may communicate with the HCMs 17 and 18 for the inner drives 7 and 8, and then the inner HCMs 17 and 18 would communicate the steering commands to the outer HCMs 16 and 19. Similarly, the actuators 12 and 13 may be connected to either the inner drive or the outer drive, as the drives are tied together and thus rotation of one drive equally rotates the other.

FIG. 2 depicts another embodiment of the steering control system and hierarchy. In the depicted embodiment, the joystick 43 and the steering wheel 41 are configured to transmit steering commands to each HCM 16-19. Thus, if either of the inner dominant HCMs 17 or 18 were to fail, steering commands could still be transmitted to the respective ACM 22, 23 from the steering wheel 41 and joystick 43. Each ACM 22, 23 may be configured to primarily listen to steering commands from the respective dominant inner HCM 17, 18 unless the HCM is not functioning, in which case that ACM 22, 23 would receive steering commands from the "slave" outer HCM 16, 19. In the depicted embodiment, each ACM 22, 23 receives the engine speed value for the associated marine drives from the respective HCMs. ACM 22 receives the engine rpm of marine drive 6 from HCM 16 and the engine rpm of marine drive 7 from HCM 17. The ACM 23 receives the engine rpm of marine drive 8 from HCM 18 and the engine rpm of marine drive 9 from HCM 19. Each ECM 36-39 communicates its engine speed to its respective HCM 16-19. However, in other embodiments, each ACM 22, 23 may receive the engine speed from the respective ECMs 36-39, as described above with respect to FIG. 1. In this embodiment, a steering fault status of one of the steering actuators 12, 13 would be communicated by the respective ACM 22, 23 to both of the associated HCMs 16 and 17, 18 and 19 associated with the faulting actuator 12, 13.

Each HCM 16-19, ACM 22, 23, and ECM 36-39 may include a computing system that includes a processing system, storage system, software, and input/output (I/O) interfaces for communicating with other devices, including the steering input devices at the helm 42, steering actuators 12, 13, and marine drives 6-9. The processing system loads and executes software from the storage system, including a software application module to control steering operations and the steering actuator. When executed by the computing system, the actuator control software application module directs the processing system to operate as described herein below in further detail to execute the method of controlling steering. While each HCM, ACM, and ECM is discussed herein as a single processing unit, one of ordinary skill in the relevant art will understand in light of the present disclosure that each HCM, ACM, and ECM may include one or many application modules and one or more processors, which may be communicatively connected. The processing system can comprise a microprocessor and other circuitry that retrieves and executes software from the storage system. Processing system can be implemented within a single processing device but can also be distributed across multiple processing devices or sub-systems that cooperate in executing program instructions. Non-limiting examples of the HCM, ACM, and ECM include general purpose central processing units, applications specific processors, and logic devices.

The storage system, which may be associated with each control module or jointly shared between control modules, can comprise any storage media readable by the processing system and capable of storing software. The storage system can include volatile and non-volatile, removable and nonremovable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

Besides the steering wheel 41 and the joystick 43, other user interfaces to provide steering control input could alternatively or additionally include a mouse, a keyboard, a voice input device, a touch input device (e.g., touch screen), and other comparable input devices and associated processing elements capable of receiving user input from an operator of the marine vessel 10. Output devices such as a video display or graphical display can display an interface further associated with embodiments of the system and method disclosed herein In the depicted embodiment, each set of marine drives is configured with propellers moving in counter rotating directions to one another. Specifically, the outer port drive 6 has propeller 26 rotating in a counter clockwise direction, and inner port drive 7 has propeller 27 rotating in a clockwise position. Similarly, inner starboard drive 8 has propeller 28 rotating in a counter clockwise direction, and outer starboard drive 9 has propeller 29 in a clockwise direction. Thus, the two inner drives, 7 and 8, have propellers 27 and 28 that rotate in directions opposite from one another. Likewise, the two outer drives 6 and 9 have propellers 26 and 29 that rotate in directions that are opposite from one another. In another embodiment, the propellers 26-29 of each marine drive 6-9 may rotate in the opposite direction than that depicted in FIG. 1. Such a configuration keeps the same relationship between the drive rotations as described above. In yet another embodiment, each drive in the pairs could have the same rotation direction and cambered skegs could be used instead of contra-rotating propellers to reduce the load. Cambered skegs have wedges on them that provides a counter force to the propeller rotation. In a preferred embodiment, the pairs are configured with contra-rotating propellers and/or cambered skegs in ordered to reduce the steering load.

Referring to FIG. 3B, each outer marine drive 6, 9 is connected to its respective inner marine drive 7, 8 by mechanical link 51, 52 at a link toe angle θ. The link toe angle θ is a running toe angle that is not modified during operation of the marine vessel 2, as the mechanical link 51, 52 is not easily adjusted during operation of the marine vessel 2 in the water. For example, the link toe angle θ is generally determined and configured upon installation or setup of the marine drives 6-9 on the marine vessel 2. The link toe angle θ is calculated to relieve some of the pressure on the steering actuators 51, 52. In one embodiment, the link toe angle θ is calculated based on a pressure reduction amount required on the steering systems at the maximum operating pressure.

Figure 4A:
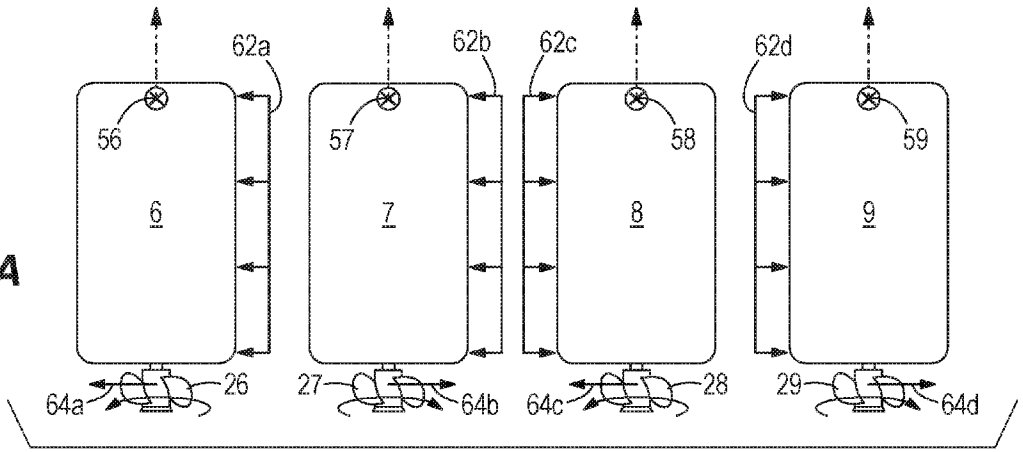
FIGS. 4A and 4B diagrammatically depict forces on four marine drives in a marine propulsion system.
Figure 4B:
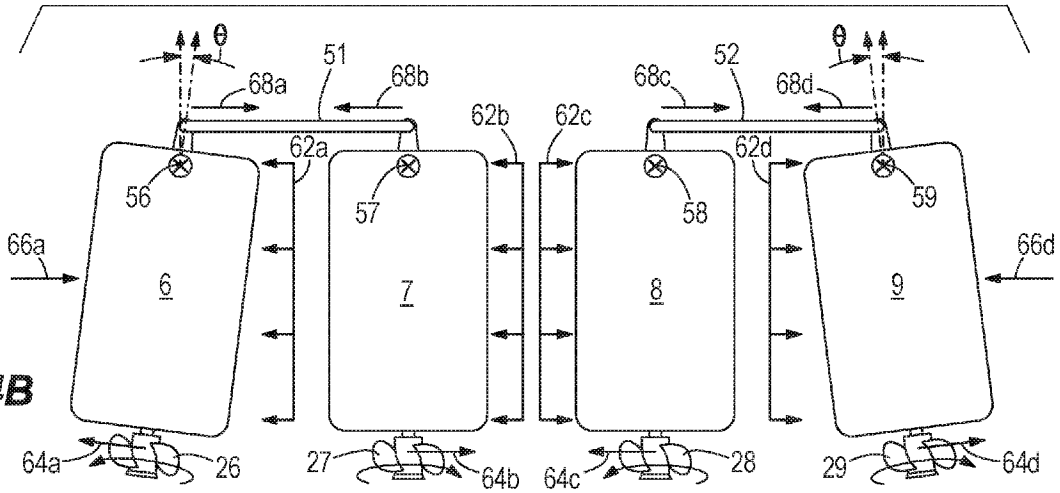

As is described above, the marine drives 6-9 experience pressure from hydrodynamic forces, including from hull displacement pressure and from propeller pressure. Hull displacement pressure 62 and propeller pressure 64 act on each marine drive 6-9. It should be understood that the hull displacement pressure 62 and the propeller pressure 64 vary with the speed of the vessel and speed of the propeller. The hull displacement and the propeller pressure at any particular speed can be added together using standard techniques of adding forces to determine the pressure on each marine drive 6-9 at that speed. FIGS. 4A and 4B provide force diagrams schematically depicting these forces on the marine drives 6-9, which will vary in magnitude with the speed of the marine vessel 2. FIG. 4A depicts all of the marine drives 6-9 in the parallel position. FIG. 4B depicts the drive sets 6 and 7, 8 and 9 connected together by mechanical links 51, 52, with the outer drives 6, 9 in a positive toe position at angle θ and the inner drives 7,8 in the parallel position. FIG. 3D shows a similar configuration, except that the outer drives 6 and 9 are configured to have negative toe, and thus are at link toe angle −θ.

The pressures on the marine drives also vary with their steering positions, and must be counteracted in some way in order to manipulate and control the position of the marine drives 6-9 in order to steer the marine vessel 2. As the hydrodynamic pressures on the drives generally increase with speed, the amount of counteracting force required at high vessel speeds is much greater than at low vessel speeds. One way to counteract the forces is to mechanically tie, or link, each set of drives together to balance the opposing propeller pressures 64*a* and 64*b*, 64*c* and 64*d*. FIG. 4B demonstrates that concept, where the mechanical links 51-52 balance some of the pressures on the marine drives 6-9 by providing counteracting forces 68*a*, 68*b*, 68*c*, and 68*d*.

Toe angle can also be used to counteract the forces on each set of marine drives 6 and 7, 8 and 9, and the corresponding pressure on the steering actuators 51, 52. The greater the magnitude of the unbalanced hull displacement pressures 62 and propeller pressures 64, the greater the toe angle needed to create counteracting toe pressure. FIG. 4B schematically depicts a scenario where toe forces 66*a* and 66*d* act on each set of marine drives 6 and 7, 8 and 9. Specifically, the outer port drive 6 is toed-in at angle θ creating toe pressure 66*a* on the drive 6 in the starboard direction. As the port set of marine drives 6 and 7 are linked together with mechanical link 51, the toe pressure 66*a* is distributed over both drives and relieves overall pressure required by the actuator 12 for the port set. Likewise, the starboard outer drive 9 may be toed-in at angle θ to create toe pressure 66*d* on the outer drive 9 to relieve pressure on the steering actuator 13. In the configuration of FIG. 4B, the inner marine drives 7, 8 are in the parallel position and are thus not encountering toe pressure. However, the inner marine drives 7 and 8 could also be toed inward (such as the configuration depicted in FIG. 3C) or toed outward (such as the configuration depicted in FIG. 3E), in which case toe pressures would also be applied to the inner marine drives 7 and 8. In that scenario, the toe pressures on the inner marine drives 7 and 8 seen by the steering actuators 12, 13 would be additive to the toe pressures 66*a*, 66*d* on the outer marine drives 6, 9. One of skill in the art will understand that if the marine drives were toed in the opposite direction than that depicted in FIG. 4B, toed out, the toe pressure exerted on the marine drives 6-9 would be opposite that depicted in FIG. 4B.

In one embodiment, the link toe angle θ may be calculated based on a pressure reduction amount needed on the steering actuator 12, 13. For example, the pressure reduction amount may be determined based on the maximum pressure expected on the steering actuator 12, 13, given the geometry and max speed of the boat, and the maximum output pressure available from the steering actuator 12, 13. For purposes of these calculations, it may be assumed that the pressures on the set of marine drives on either side of the centerline 10 are equal. Thus, in the depicted embodiment, each of the outer drives 6, 9 is assumed to experience the same pressure magnitude, albeit in opposite directions, and each of the inner marine drives 7, 8 is assumed to experience the same pressure magnitudes in opposite directions. Thus, the hull displacement pressure 62 and the propeller pressure 64 may be derived for each inner drive 7, 8 and each outer drive 6, 9.

In one embodiment, the hull displacement pressure and the propeller pressure on each of the inner drives 7, 8 and outer drives 6, 9 are determined as a function of speed. In general, one of skill in the art will understand that the maximum pressure on each drive 6-9 is not necessarily at the maximum speed of the vessel 2. In general, hull displacement pressure tends to decrease as a vessel 2 approaches its maximum speed, while the propeller pressure 64 tends to increase with speed. The propeller pressure and the hull displacement pressure may be summed to derive the pressure on each of the inner drives 7, 8 and outer drives 6, 9, as depicted in FIG. 4A for example, to determine the total pressure on the inner drives 7, 8 and the outer drives 6, 9 at a range of vessel speeds. Based thereon, a maximum required actuator pressure can be determined, which is the actuator pressure required to counteract the maximum collective pressure from the outer drives 6, 9 and the inner drives 7, 8 in the set. In one embodiment, it may be assumed that the inner drives 7, 8 and the outer drives 6, 9 see a maximum pressure at the same vessel speed, in which case the maximum required actuator pressure may be calculated as the maximum outer drive pressure (which is the maximum pressure placed on the steering actuator from the outer drive) plus the maximum inner drive pressure (which is the maximum pressure placed on the steering actuator from the inner drive).

A link toe angle θ is then calculated based on the pressure reduction amount. In one embodiment, a maximum outer toe angle and a maximum inner toe angle are calculated to achieve a total toe pressure equal to the pressure reduction amount. Preferably, each of the maximum inner toe angle and the maximum outer toe angle are between −3° and 3°. The link toe angle θ may then be calculated on the maximum inner and outer toe angles. In one embodiment, the link toe angle θ is calculated according to the following equation:

$$\theta=(\text{max outer toe angle}-\text{max inner toe angle})/2$$

The set of marine drives is then connected together to achieve the link toe angle. As depicted in FIG. 2B, this can be achieved by rotating each outer marine drive 6, 9 to a positive toe angle equal to the link toe angle θ. Alternatively, both of the drives in the set can be rotated such that their foremost ends are turned toward one another (a relative toe-in position for the set) such that the toe angle of the inner marine drive 7, 8 plus the toe angle of the outer marine drive 6, 9 (where both toe angles are considered positives) equal the link toe angle θ. The mechanical link 51, 52 maintains the relative angle between the drives in each set 6 and 7, 8 and 9 at the link toe angle θ.

Each set of marine drives 6 and 7, 8 and 9 are then separately steerable, as described above. While in joysticking mode, it may be desirable to steer each set 6 and 7, 8 and 9 separately to different steering angles. However, when traveling straight ahead towards at high speeds and/or under high steering loads, it is desirable to rotate the sets 6 and 7, 8 and 9 in equal and opposite directions so that any lateral propulsion forces created by the drives are counteracted. At high speeds and/or high steering loads, the sets of marine drives 6 and 7, 8 and 9 may be positioned by the respective steering actuators 12, 13 in a positive toe, or "toe-in" position. FIG. 3C depicts an embodiment where the steering actuators 12, 13 have positioned each set of marine drives 6 and 7, 8 and 9 to actuator toe angle Φ. Accordingly, each inner marine drive 7, 8 is positioned at toe angle Φ, and each outer marine drive 6, 9 is positioned at toe angle Φ+θ. Likewise, the sets of marine drives 6 and 7, 8 and 9 may be positioned by the respective steering actuators 12, 13 in a negative toe, or "toe-out" position. FIG. 3E depicts an embodiment where the steering actuators 12, 13 have positioned each set of marine drives 6 and 7, 8 and 9 to actuator toe angle −Φ. Accordingly, each inner marine drive 7, 8 is positioned at toe angle −Φ, and each outer marine drive 6, 9 is positioned at toe angle −Φ+−θ. In one embodiment, the actuator toe angle Φ is determined by accessing a value in a toe angle lookup table based on the speed of the vessel. The toe angle lookup table is, for example, a table of angle values for the range of speeds that could be traveled by a particular marine vessel 2, wherein each angle value is calculated to produce a particular collective toe pressure on the sets of drives 6 and 7, 8 and 9 needed to counteract the hull displacement pressures and propeller pressures at that speed.

Figure 5:
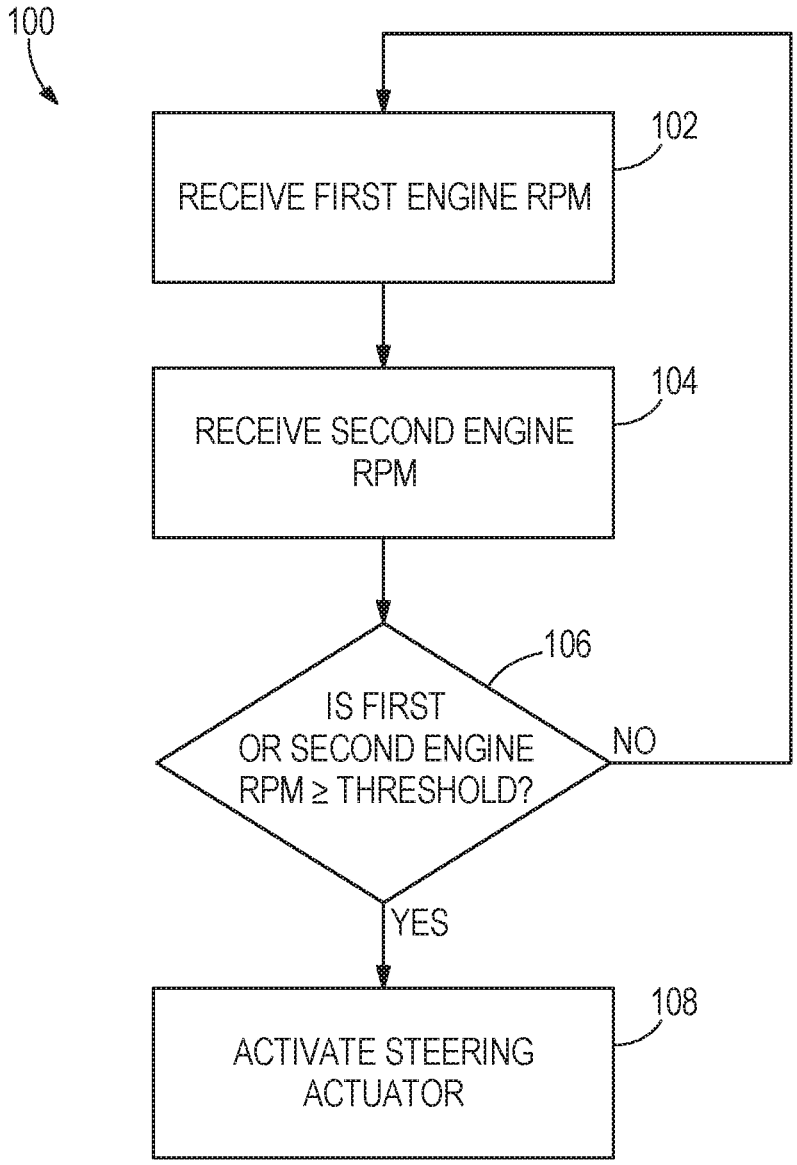
FIG. 5 illustrates one example of a method of controlling steering of at least two marine drives connected by a mechanical link.

FIG. 5 depicts one embodiment of a method 100 for controlling steering of a set of marine drives that are connected by a mechanical link. As described above, the steering control methods and systems describe herein may apply equally to a propulsion system 1 having only one set of marine drives, and such set may include two, three, or more drives. Thus, the set of marine drives may be any two or more drives connected together by a mechanical link such that steering can be enacted by a single steering actuator. At step 102, an engine speed of a first marine drive is received at an actuator control module that controls a steer-by-wire steering actuator. At step 104, the actuator control module receives an engine speed of the second marine drive. At step 106, the actuator control module determines whether at least one of the first engine speed or the second engine speed is at least a threshold value. If so, then the steering actuator is activated at step 108, such as by powering on the steering actuator. For example, the steering actuator may be powered by either of a first battery in the first marine drive or a second battery in the second marine drive, and may alternately connect and receive charge from either battery based on which battery has more charge, as is described above with respect to the embodiments of FIGS. 1 and 2. Depending on the steering control configuration, the actuator control module may receive the engine speed value from the engine control modules in each of the respective first and second marine drives. Alternatively, the actuator control module may receive the engine speed value for one or both of the first and second marine drives from the associated helm control modules for that drive.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A system for steering a marine vessel, the system comprising:

a first marine drive having a first engine control module and a second marine drive having a second engine control module, where the first and second marine drives are connected by a mechanical link;

a first steer-by-wire steering actuator configured to rotate the first and second marine drives to steer the marine vessel; and a first actuator control module that controls the first steer-by-wire steering actuator;

wherein the first actuator control module activates the first steer-by-wire steering actuator if either the first marine drive or the second marine drive is running.

2. The system of claim 1, wherein the first steer-by-wire steering actuator is one of an electric steering actuator, an electric over hydraulic steering actuator, or a hydraulic steering actuator.

3. The system of claim 1, further comprising a switch that alternately connects the first steer-by-wire steering actuator to a first battery for the first marine drive or to a second battery for the second marine drive based on which battery has more charge.

4. The system of claim 3, wherein the switch is an automatic transfer switch.

5. The system of claim 3, wherein the switch is a relay operated by the first actuator control module.

6. The system of claim 1, wherein the first actuator control module determines whether the first marine drive is running by receiving an engine speed of the first marine drive, and determines whether the second marine drive is running by receiving an engine speed of the second marine drive, wherein the first actuator control module activates the first steer-by-wire steering actuator if the engine speed of the first marine drive or the engine speed of the second marine drive is at least a threshold value.

7. The system of claim 6, wherein the first actuator control module is communicatively connected to the first engine control module and the second engine control module, such that the first actuator control module receives the engine speed of the first marine drive from the first engine control module and the engine speed of the second marine drive from the second engine control module.

8. The system of claim 7, wherein the first actuator control module is communicatively connected to the first engine control module and the second engine control module via a CAN bus.

9. The system of claim 6, wherein the first actuator control module is communicatively connected to a first helm control module and a second helm control module, such that the first actuator control module receives the engine speed of the first marine drive from the first helm control module and the engine speed of the second marine drive from the second helm control module.

10. The system of claim 6, further comprising:

a first helm control module communicatively connected to the first actuator control module, and wherein the first actuator control module is communicatively connected to the first engine control module; and a second helm control module communicatively connected to the second engine control module and the first helm control module;

wherein the first actuator control module receives the engine speed of the first marine drive from the first engine control module and receives the engine speed of the second marine drive from the first helm control module.

11. The system of claim 1, wherein the first actuator control module communicates a steering fault status to a first helm control module associated with the first marine drive, and the first helm control module communicates the steering fault status to a second helm control module associated with the second marine drive.

12. The system of claim 1, further comprising:

a third marine drive having a third engine control module and a fourth marine drive having a fourth engine control module, where the third and fourth marine drives are connected by a mechanical link;

a second steer-by-wire steering actuator configured to rotate the third and fourth marine drives to steer the marine vessel; and a second actuator control module that controls the second steer-by-wire steering actuator;

wherein the second actuator control module activates the second steer-by-wire steering actuator if either the third or fourth marine drive is running.

13. The system of claim 12, wherein the first marine drive and the fourth marine drive are slaves and are in an outer position on the marine vessel, and the second marine drive and the third marine drive are dominant and are in an inner position on the marine vessel.

14. The system of claim 12, wherein the first marine drive and the fourth marine drive are dominant and are in an inner position on the marine vessel, and the second marine drive and the third marine drive are slaves and are in an outer position on the marine vessel.

15. A method for controlling steering of a set of marine drives connected by a mechanical link, the method comprising:

receiving an engine speed of a first marine drive at an actuator control module that controls a steer-by-wire steering actuator;

receiving an engine speed of a second marine drive at the actuator control module;

determining that at least one of the first engine speed or the second engine speed is at least a threshold value; and activating the steer-by-wire steering actuator to rotate the first and second marine drives to steer the marine vessel.

16. The method of claim 15, wherein the actuator control module receives the engine speed of the first marine drive from a first engine control module associated with the first marine drive, and the actuator control module receives the engine speed of the second marine drive from a second engine control module associated with the second marine drive.

17. The method of claim 15, wherein the actuator control module receives the engine speed of the first marine drive from a first helm control module associated with the first marine drive, and the actuator control module receives the engine speed of the second marine drive from a second helm control module associated with the second marine drive.

18. The method of claim 15, wherein the actuator control module receives the engine speed of the first marine drive from a first engine control module associated with the first marine drive, and the actuator control module receives the engine speed of the second marine drive from one of a second helm control module associated with the second marine drive or a first helm control module associated with the first marine drive communicatively connected to the second helm control module.

19. The method of claim 15, further comprising detecting a steering fault status of the steer-by-wire steering actuator at the actuator control module, communicating the steering fault status from the actuator control module to a first helm control module associated with the first marine drive, and communicating the steering fault status from the first helm control module to a second helm control module associated with the second marine drive.

20. The method of claim 15, further comprising alternately connecting the first steer-by-wire steering actuator to a first battery for the first marine drive or to a second battery for the second marine drive based on which battery has more charge.

* * * * *